US005382749A

United States Patent [19]

Fujita et al.

[11] Patent Number: 5,382,749

[45] Date of Patent: Jan. 17, 1995

[54] WAVEFORM DATA PROCESSING SYSTEM AND METHOD OF WAVEFORM DATA PROCESSING FOR ELECTRONIC MUSICAL INSTRUMENT

[75] Inventors: Akihiro Fujita; Katsushi Ishii, both of Iwata, Japan

[73] Assignee: Kawai Musical Inst. Mfg. Co., Ltd., Shizuoka, Japan

[21] Appl. No.: 39,768

[22] Filed: Mar. 30, 1993

[30] Foreign Application Priority Data

Mar. 30, 1992 [JP] Japan ..... 4-073698
Mar. 30, 1992 [JP] Japan ..... 4-073699

[51] Int. Cl.[6] ..... G10H 7/00

[52] U.S. Cl. ..... 84/603; 84/604; 84/615

[58] Field of Search ..... 84/601, 602, 603, 604, 84/615, 645

[56] References Cited

U.S. PATENT DOCUMENTS

| | | | |
|---|---|---|---|
| 4,508,001 | 4/1985 | Suzuki | 84/604 |
| 5,198,603 | 3/1993 | Nishikawa et al. | 84/601 |
| 5,225,618 | 7/1993 | Wadhams | 84/604 |
| 5,252,775 | 10/1993 | Urano | 84/645 |

*Primary Examiner*—William M. Shoop, Jr.
*Assistant Examiner*—Jeffrey W. Donels

[57] ABSTRACT

A waveform memory for storing data of musical tone waveforms can be mounted in and dismounted from an electronic musical instrument body. The waveform memory is thus replaceable, permitting the sounding of tones with various varieties. In addition, if musical tone waveform data corresponding to a tone designated for sounding is not stored in the memory, it is automatically loaded in the memory, thus permitting automatic sounding of tones to be requested.

24 Claims, 17 Drawing Sheets

WORKING MEMORY 22

WAVEFORM DATA PROCESSING SYSTEM AND METHOD OF WAVEFORM DATA PROCESSING FOR ELECTRONIC MUSICAL INSTRUMENT

BACKGROUND OF THE INVENTION

1. Field of the Invention

This invention relates to a waveform data processing system and a method of waveform data processing for electronic musical instruments and, more particularly, to control of writing and reading data of musical tone waveforms in electronic musical instruments.

2. Description of the Related Art

In a prior art tone generator for an electronic musical instrument, sampled musical tone waveform data is stored in a waveform memory, and is read out when a key-"on" event signal is supplied. The key-"on" event signal is also supplied to an envelope generator for calculating envelope waveform data. The envelope waveform data is used to multiply the musical tone waveform data for D-A (digital-to-analog) conversion, the converted data being output. The key-"on" event signal may correspond to an "on" event concerning a keyboard key or correspond to automatic performance information.

In the waveform memory, musical tone waveform data of sinusoidal waves, triangular waves, rectangular waves, etc., is stored for one wavelength portion, and it is read out repeatedly at a rate corresponding to the tone pitch. In some tone generators, for more closely approximating sounds of actual musical instruments, musical tone waveform data of a plurality of gradually changing waveforms or an attack waveforms of musical tones and portions of waveforms subsequent from the attack is stored in a waveform memory.

However, the musical tone waveform data stored in the waveform memory is fixed and cannot be altered. Therefore, tones sounded in performance have fixed tone color and poor variations.

To obtain sounding of tones having a variety of tone colors, it is necessary to store a great number of different kinds of musical tone waveform data, and doing so requires an enormous waveform memory capacity and a complicated process for selecting and accessing stored data.

The present invention seeks to solve the above problems, and its object is to provide a waveform data processing system, which permits sounding tones of a great variety of tone colors without the need to increase the storage capacity of a waveform memory means.

With the prior art tone generator, there are cases when waveform data stored in the waveform memory is not desired by the operator, that is, waveform data corresponding to musical tones desired to be sounded may fail to be stored. Particularly, when waveform data corresponding to tones desired to be sounded fail to be stored in the case of automatic performance, the performance may fail to be executed or may be interrupted.

Another object of the invention is to provide a waveform data processing system for an electronic musical instrument, which permits necessary musical tone waveform data to be automatically transferred and stored.

SUMMARY OF THE INVENTION

According to the invention, a first waveform storage means for storing data of musical tone waveforms is provided such that it can be mounted in and dismounted from an electronic musical instrument body. Musical tone waveform data is read out from the first waveform storage means and written in a second waveform storage means provided in the electronic musical instrument body. The written musical tone waveform data is used for tone generation. The musical tone waveform data for the tone generation thus can be changed variously by replacing the first waveform storage means and without need for increasing the storage capacity of the second waveform storage means provided in the electronic musical instrument body.

With respect to a tone designated for generation, a check is made as to whether corresponding waveform data is stored in the second waveform storage means, in which musical tone waveform data used for the tone generation is stored. Depending on the result of the check, the musical tone waveform data noted above is read out from the first waveform storage means and is written in the second waveform storage means. Thus, even if musical tone waveform data corresponding to a tone desired to be sounded is not stored, it is automatically supplied from the first to the second waveform storage means. The tone to be sounded can thus be sounded without fail.

DETAILED DESCRIPTION OF THE PREFERRED EMBODIMENT

Summary of the Embodiment

Figure 1:
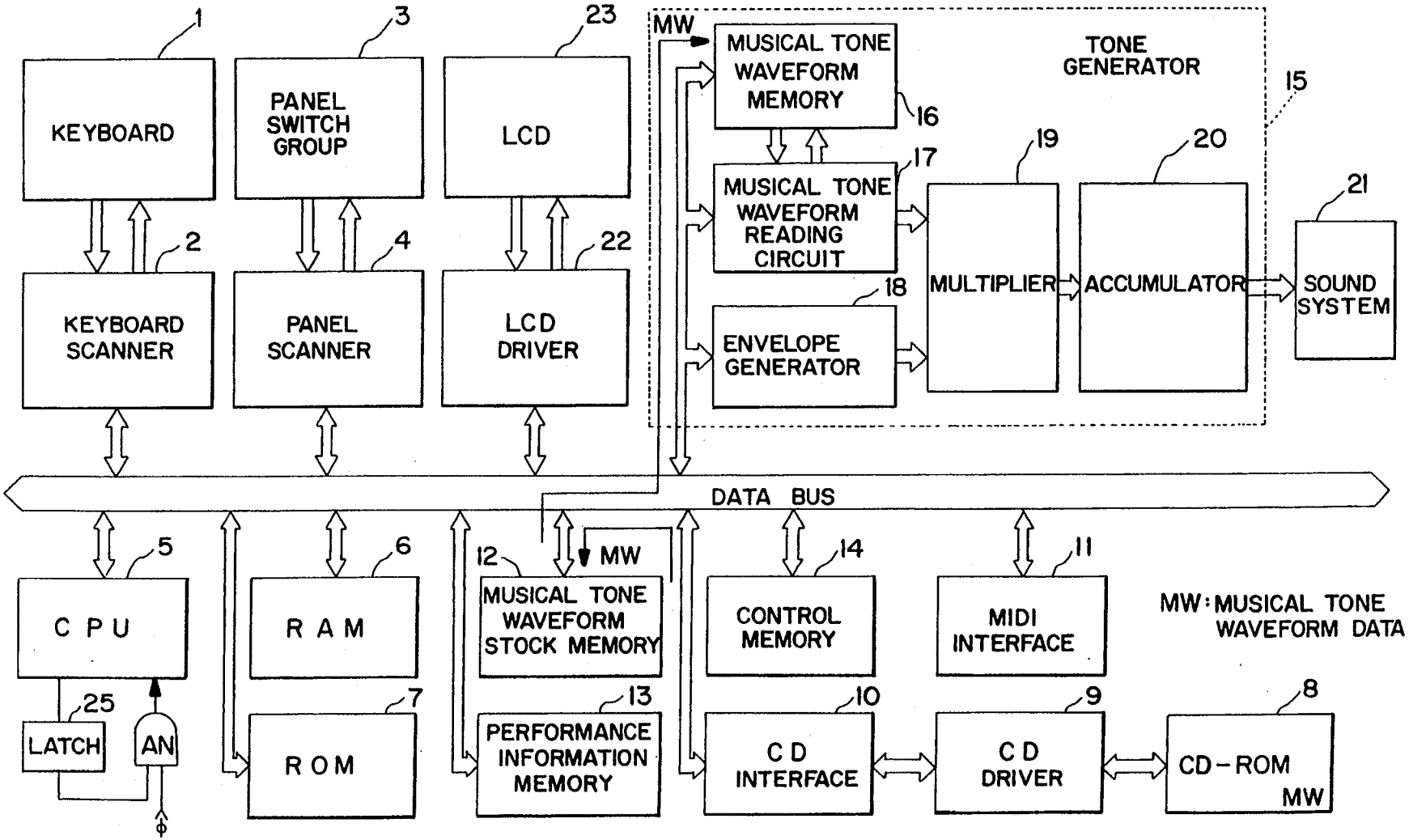
FIG. 1 is a block diagram showing the overall circuit of an electronic musical instrument.

In a CD-ROM 8, which can be mounted and dismounted, various musical tone waveform data MW are stored. These data MW can be loaded in a musical tone waveform stock memory 12 and also loaded in a musical tone waveform memory 16 in a tone generator 15. The loaded musical tone waveform data MW are selected according to tone number data TN. The tone number data TN is input from a panel switch group 3, or is stored within performance information MP, or is supplied via a MIDI interface 11.

When a song selection key 33 is operated, reproduced song number data RSN is changed (steps 81 to 84), and then a check is made as to whether musical tone waveform data MW corresponding to the tone number data TN in the performance information MP concerning the song selection is stored in the musical tone waveform memory 16 (steps 85 to 87). If the data is not stored, it is loaded from the musical tone waveform stock memory 12 into the musical tone waveform memory 16 (steps 88 to 90).

1. Overall Circuit

FIG. 1 shows the overall circuit of an electronic musical instrument. A keyboard 1 has keys which can be scanned by a keyboard scanner 2 for detecting data indicative of key-"on" and key-"off" events. A CPU 5 writes the detected data into a RAM 6 and compares the data with "on"/"off" state data for each key having been stored in the RAM 6, thus judging an "on" or "off" event concerning each key. The keyboard 1 may be replaced with an electronic string instrument, an electronic reed instrument, an electronic pad instrument, a computer keyboard, etc.

A panel switch group 3 has keys which are scanned by a panel scanner 4. The scanner detects "on"/"off" data for each switch. The CPU 5 writes the detected data in the RAM 6 and compares the data with "on"/"-off" state data for each key having been stored in the RAM 6, thus judging an "on" or "off" event concerning each switch.

In the RAM 6 are stored, in addition to the above various data, data to be processed by the CPU 5 and also data necessary for the processing. The RAM 6 has working memory 22 to be described later. In a ROM 7 are stored programs, which correspond to flowcharts to be described later, and which are executed by the CPU 5, and also programs corresponding to other processes.

In the CD-ROM 8 are stored various musical tone waveform data MW, which are waveform sampling data of musical instruments such as a piano, violin, flute, cymbal, etc. The individual musical tone waveform data are selected according to tone number data TN. In the CD-ROM 8 are also stored performance information MP on a plurality of songs. The performance information MP is data for automatic performance such as melody, chord, rhythm, etc..

In the CD-ROM 8 are further stored various kinds of control information CT. The control information CT includes data indicative of the start of reading of the musical tone waveform data MW noted above, loop top and loop end address data, envelope waveform data, touch data, key scaling data, etc.. The tone color of each tone is determined by the control information CT and tone number data TN. Data of the musical tone waveforms includes the control information CT in addition to the musical tone waveform data MW.

The performance information MP comprises a plurality of sequential event data. One piece of event data EV comprises status data SS, the above parameter data PR and step time data ST. The status data SS comprises key-"on"/"Off" data, key number data KN, chordtype data and chord root data, or touch data.

The parameter data PR is indicative of the function level of the status data SS; for instance, it is data for controlling the touch, tone color, performance part, etc. The step time data ST represents time from bar mark data BM to event execution. The bar mark data BM represents a bar. End mark data ED represents the end of a song. The tone number data TN and control information CT or data designating the control information CT may be stored at the head of each piece of performance information MP or at a musical factor change point therein.

Volume distributer VD is stored in a head logic sector in the CD-ROM 8. The volume distributer VD comprises volume name data VN and directory DR. The volume name data VN represents the kind of memory such as the storage type of the CD-ROM 8.

The directory data DR comprises a file name, file size and head sector number of each piece of performance information MP, control information CT and each piece of musical tone waveform data MW and comprises all song number data ASN of performance information MP. The file name represents the song name with respect to the performance information MP, the tone number data TN with respect to the musical tone waveform data MW and the kind with respect to the control information CT.

The CD-ROM 8 is driven by the CD driver 9, and each piece of information that is read out as a result is supplied to the bus line through the CD interface 10. Performance information MP is further supplied to the bus line through the MIDI interface 11. This performance information MP is the same as the performance information MP of the CD-ROM 8. The CD interface 10 is of non-synchronous serial type, but it may be of synchronous parallel type as well.

The musical tone waveform data MW read out from the CD-ROM 8 is all loaded in the musical tone waveform stock memory 12 by the CPU 5. Performance information MP read out from the CD-ROM 8 and sent via a MIDI interface 11 is loaded in the performance information memory 13 by the CPU 5. Further, control information CT read out from the CD-ROM 8 is loaded in the control memory 14 by the CPU 5. The MIDI interface 11 may of a type other than the MIDI type.

As for musical tone waveform data MW in the musical tone waveform stock memory 12, the data that is selected by the CPU 5 is further loaded in the musical tone waveform memory 16 in the tone generator 15. The performance information PM (i.e., tone number data TN, key-"on"/"off" data, and pitch (or key number) data) in the performance information memory 13 or control information CT (i.e., envelope waveform data, touch data, and key scaling data) in the control memory 14, is supplied to the musical tone waveform reading circuit 17, and corresponding musical tone waveform data MW is read out from the musical tone waveform memory 16.

Further, the performance information MP (i.e., key-"on"/"off" data) in the performance information memory 13 and control information CT (i.e., envelope waveform data, touch data and key scaling data) in the control memory 14, is supplied to the envelope generator 18 for generation of corresponding envelope waveform data EN.

The musical tone waveform data MW and envelope waveform data EN are supplied to the multiplier 19 for multiplication, then to the accumulator 20 for accumulation and then to the sound system 21 for reproduction.

In the musical tone waveform reading circuit 17 and envelope generator 18, musical tone generation systems for a plurality of channels are formed for a time division processing for polyphonic sounding of tones. To the LCD 23, various data in the RAM 6 supplied through the LCD driver 24 are displayed.

To the CPU 5, a clock signal $\phi$ having a fixed frequency is supplied through an AND gate AN for execution of an interrupt process. To the AND gate AN, one-bit data is supplied as an enable signal from the time count latch 25. The one-bit data is output from the CPU 5.

2. Musical Tone Waveform Data MW

Figure 2:
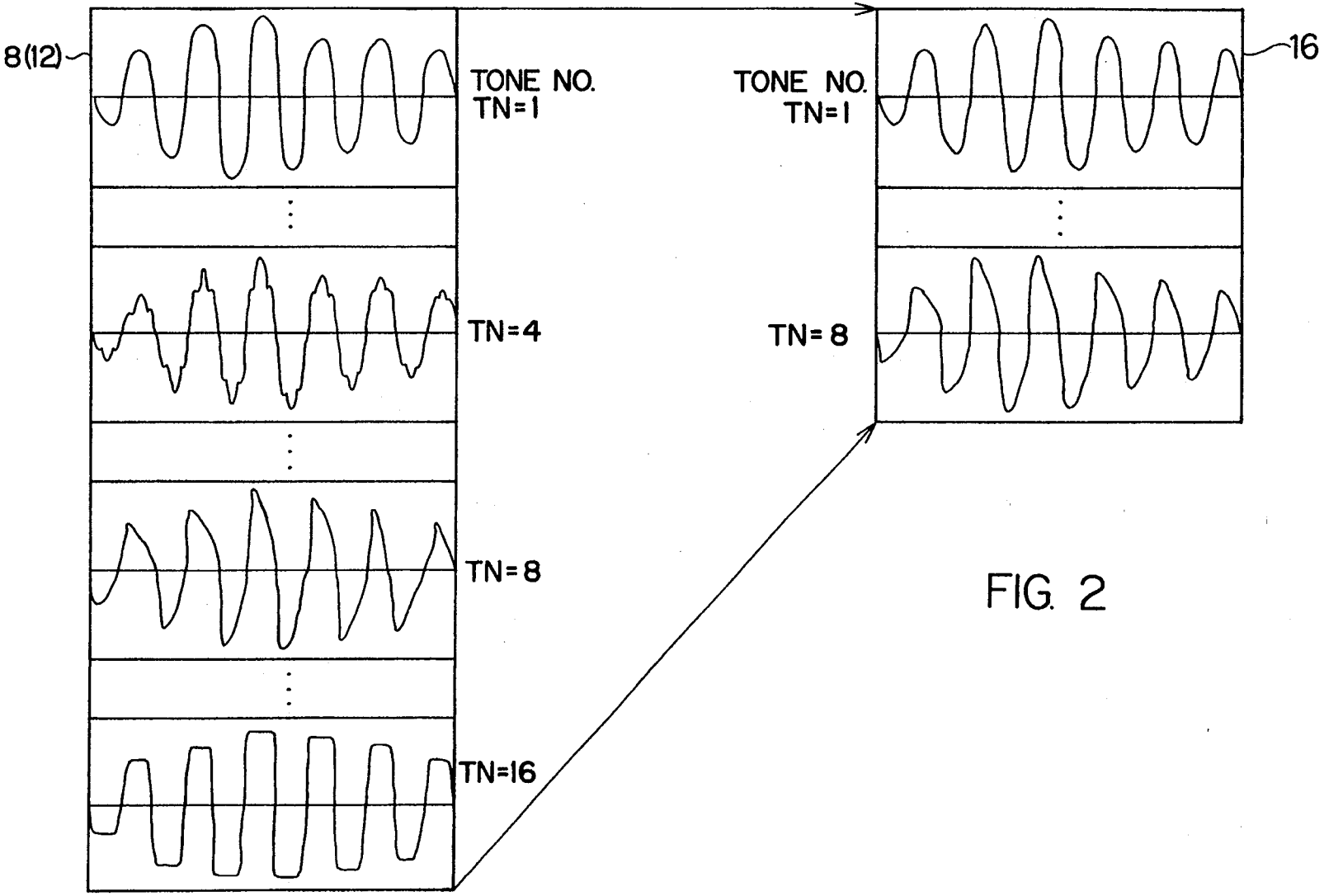
FIG. 2 is a view showing the content of musical tone waveform data MW.

FIG. 2 shows musical tone waveform data MW which is stored in the CD-ROM 8, musical tone waveform stock memory 12 and musical tone waveform memory 16. The musical tone waveform data MW is sampling data corresponding to the sounds of various musical instruments such as a piano, violin, flute, cymbal, etc.. These waveforms can be corresponding to waveforms such as sine waves, chopping (sawtooth) waves, rectangle waves, etc., corresponding to ratios of specific components such as harmonic components or noise components, corresponding to groups of spectra of specific frequency bands according to specific formats, corresponding to various kinds of while or partial waveforms between a start and end or middle of a sound, or corresponding to touch data, range of touch data, pitch data or/and range of pitch data.

It is possible to dispense with the musical tone waveform memory 12 and permit direct loading of selected musical tone waveform data MW in the musical tone waveform memory 16 from the CD-ROM 8. Further, it is possible to interchange the musical tone waveform stock memory 12 and the musical tone waveform memory 16 to permit the musical tone waveform reading circuit 17 to read out data from the interchanged musical tone waveform memory 16 when sounding tones.

Further, musical tone waveform data MW may be read out directly from the CD-ROM 8 when sounding tones. In this case, a high read-out rate ROM/RAM card is used as the CD-ROM 8. Further, it is possible to load all the musical tone waveform data MW from the CD-ROM 8 in the musical tone waveform memory 16.

3. Panel Switch Group 3

Figure 3:
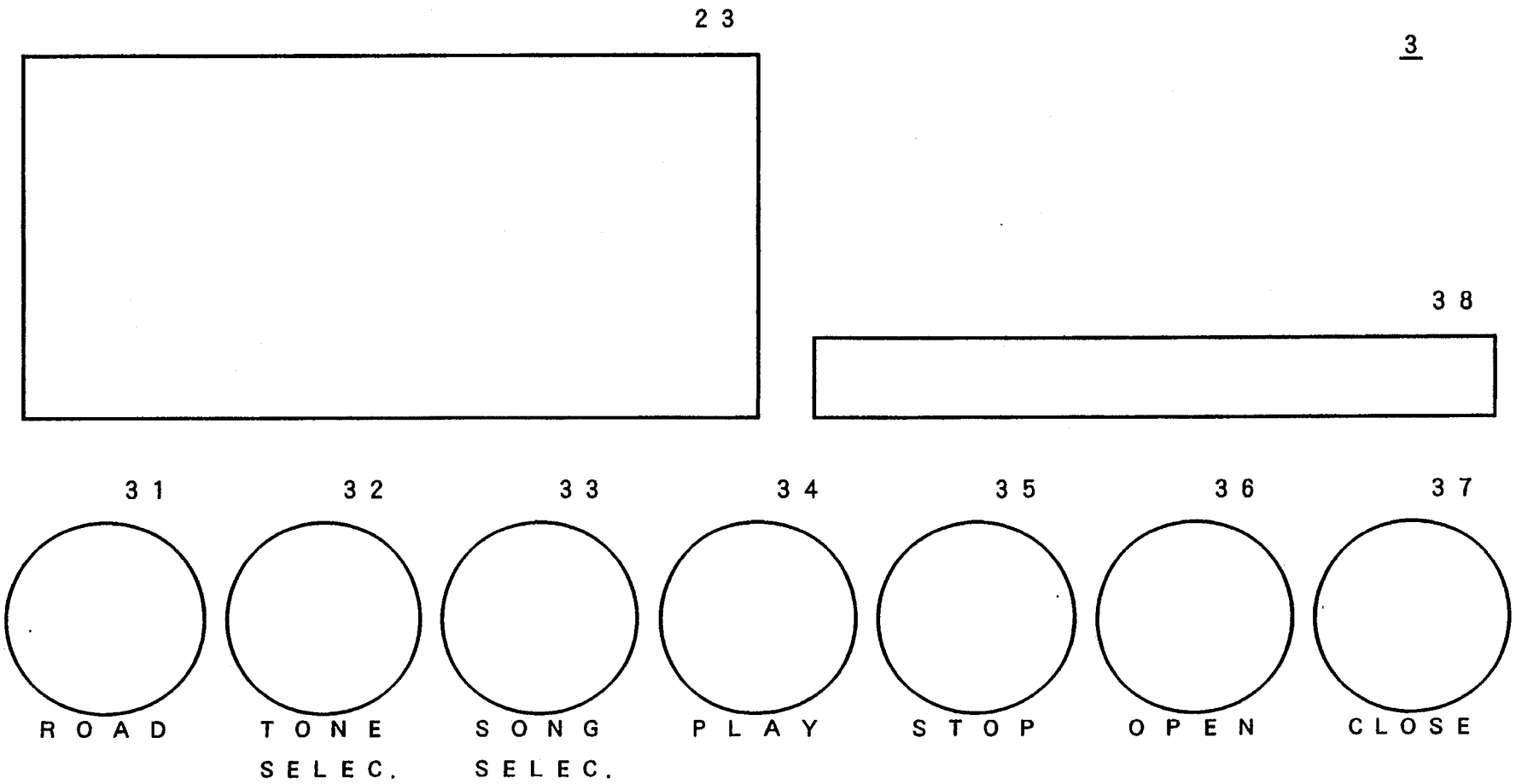
FIG. 3 is a view showing a panel switch group 3 and a LCD 23.

FIG. 3 shows the panel switch group 3 and LCD 23. The panel switch group 3 includes a load key 31, a tone color selection key 32, a song selection key 33, a play key 34, a stop key 35, an open key 36, a close key 37 and a disk holder 38. The load key 31 is for instructing the loading of musical tone waveform data MW from the CD-ROM 8 in the musical tone waveform stock memory 12 or the loading of musical tone waveform data MW from the musical tone waveform stock memory 12 in the musical tone waveform memory 16.

The tone color selection key 32 is for selecting tone color (i.e., tone number data TN), that is, musical tone waveform data MW in the musical tone waveform memory 16. It operates in a ring type operation. such as "0"→"1"→"2" . . . "0"→"1" for the tone number selection. However, tone number data TN in musical tone waveform data MW not stored in the musical tone waveform memory 16 is skipped or is subject to ring operation. The load key 31, as well as the tone color selection key 32, can function to select and change the tone color of performed musical tones.

The song selection key 33 is for selecting performance information MP about a plurality of songs in the performance information memory 13. The play key 34 is for starting automatic performance with respect to the performance information MP on a selected song. The stop key 35 is for stopping the automatic performance.

The open key 36 is for opening the lid of the disk holder 38, and the close key 37 is for closing the lid. The CD-ROM 8 can be loaded in and unloaded from the disk holder 38. In the disk holder 38, a sensor switch is provided to detect the loading/unloading of the CD-ROM 8, and also a mechanism for opening and closing the disk holder 38 is provided. On the LCD 23, tone number data TN selected by the tone color selection key 32, song number and song name selected by the song selection key 33 are displayed. It is possible to substitute a ten-key keypad for the tone color and song selection keys 32 and 33.

4. Working Memory 22

Figure 4:
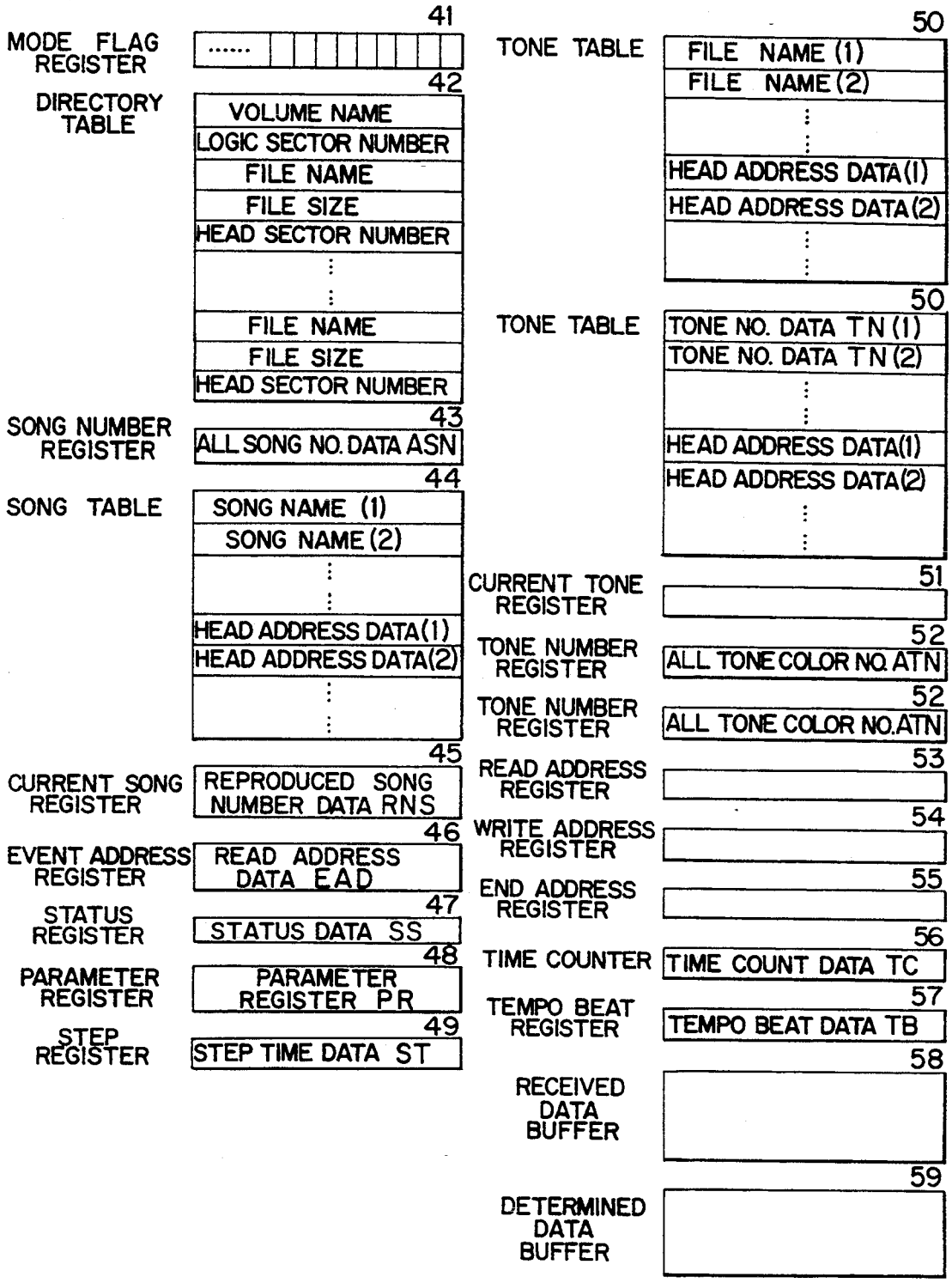
FIG. 4 is a view showing a working memory 22 in a RAM 6.

FIG. 4 is shows the working memory 22 in the RAM 6. In the working memory 22 are formed various registers, counters, pointers and tables as shown in FIG. 4.

In a mode flag register 41 is stored mode flag data indicative of the mode of operation of the electronic musical instrument. The mode flag data is indicative of whether bar mark data BM of performance information MP is read out continuously (2nd bit), loading/unloading of the CD-ROM 8 (3rd bit), opening/closing of the disk holder 38 (4th bit), presence/absence of control information CT (5th bit), reading/non-reading of data from the CD-ROM 8 (6th bit), execution/non-execution of automatic performance (7th bit), and loading/non-loading of musical tone waveform data MW (8th bit).

In a directory table 42 is stored the volume distributer VD, i.e., volume name data VN and directory data DR. The directory data DR stored indicates the file name, file size and head sector number with respect to each piece of performance information MP, each piece of control information CT and each piece of musical tone waveform data MW. It is exclusive of all song number data ASN of performance information MP. It further includes a logic sector number of the CD-ROM 8 stored in the volume distributer VD.

In a song number register 43 is stored the all song number data ASN of the performance information MP. In a song table 44 are stored the song name of each piece of performance information MP and the head address data of each song in the performance information memory 13 in combination.

In a current song register 45 is stored the song number data, i.e., reproduced song number data RSN, of performance information MP being automatically performed. In an event address register 46 is stored read address data EAD with respect to the performance information memory 13. In a status register 47 is stored status data SS of event data EV read out from the performance information memory 13. In a parameter register 48 is stored parameter data PR of event data EV read out from the performance information memory 13. In a step register 49 is stored step time data ST of event data EV read out from the performance information memory 13.

In two tone tables 50 are stored in combination the tone number data TN of each piece of musical tone waveform data MW and the head storage address data of each piece of musical tone waveform data MW in the musical tone waveform stock memory 12 or musical tone waveform memory 16. In a current tone register 51 is stored point data designating the tone number data TN of a tone to be sounded in the tone tables 50. It is possible to provide a plurality of current tone registers 51 for simultaneously sounding a plurality of tones of different tone colors. Further, it is possible to provide a table 50 for the control information CT in the control memory 14.

In tone number registers 52 is stored all tone color number data ATN. The All tone color number data is indicative of the total number of pieces of tone number data TN stored in the tone tables 50, i.e., the total number of pieces of musical tone waveform data MW stored in the musical tone waveform memory 16 or musical tone waveform stock memory 12. Two tone number registers 52 are provided in correspondence to the two tone tables 50 noted above.

In a read address register 53 is stored read address data for reading data from the musical tone waveform stock memory 12, musical tone waveform memory 16 or CD-ROM 8. In a write address register 54 is stored write address data for writing data in the musical tone waveform stock memory 12 or musical tone waveform memory 16. In an end address register 55 is stored end address data of the last read-out address of the musical tone waveform stock memory 12 or musical tone waveform memory 16.

A time counter 56 is incremented by "+1" by the CPU 5 whenever the clock signal $\phi$ goes to a high level. In this way, the counting of time count data TC is effected. In a tempo beat register 57 is stored tempo beat data TB corresponding to the tempo and beat. This tempo beat data TB is equal to the maximum value of the step time data ST, and the time count data TC is cleared when the time count data TC becomes identical to the tempo beat data TB.

In a received data buffer 58 is temporarily stored performance information MP supplied through the MIDI interface 10. The performance information MP in the received data buffer 58 is successively transferred to a determined data buffer 59.

5. Main Routine

Figure 5:
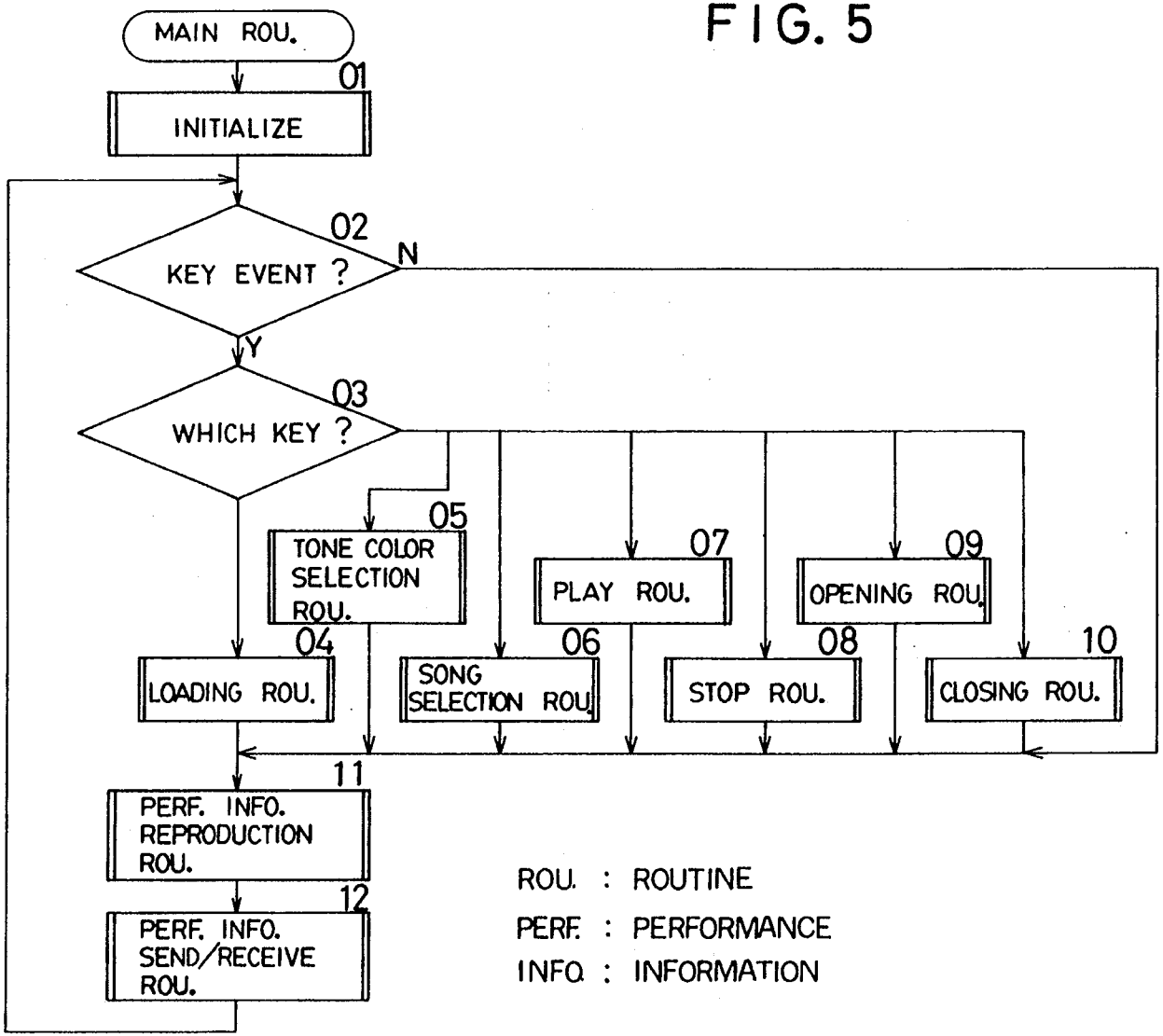
FIG. 5 is a flowchart showing a main routine.

FIG. 5 shows the flowchart of a main routine executed by the CPU 5. The routine is started by the turning on of the power source. In the first place, the RAM 6, working memory 22, musical tone waveform stock memory 12, performance information memory 13, control memory 14 and musical tone waveform memory 16 are cleared for initilization (step 01). Subsequently, if a key-"on" event is detected among the switches or keys 31 to 37 in the panel switch group 3 (step 02), the type of the event is determined (step 03).

If the key pertaining to the event is the load key 31, a loading routine is executed (step 04). If the key pertaining to the event is the tone color selection key 32, a tone color selection routine is executed (step 05). If the key pertaining to the event is the song selection key 33, a song selection routine is executed (step 06). If the key pertaining to the event is the play key 34, a play routine is executed (step 07). If the key pertaining to the event is the stop key 35, a stop routine is executed (step 08). If the key pertaining to the event is the open key 36, an opening routine is executed (step 09). If the key pertaining to the event is the close key 37, a closing routine is executed (step 10). Subsequently, a performance information MP reproduction routine (step 11) and then a performance information WP send/receive routine (step 12) are executed. The routines in the steps 04 to 12 will be described later.

6. Opening Routine

Figure 6:
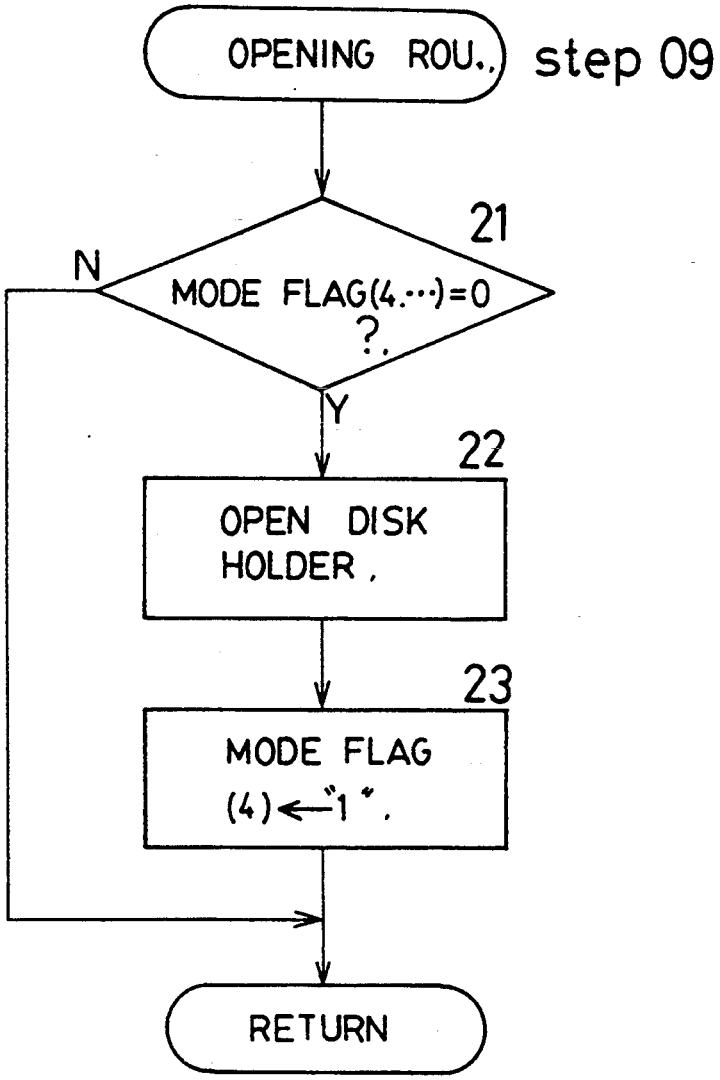
FIG. 6 is a flowchart showing a routine (step 09) of opening a disk holder 38.

FIG. 6 shows the routine executed in the step 09 to open the disk holder 38. In this routine, if the 4th and following bits of the data in the mode flag register 41 are "00 . . . 0" and nothing is being executed (step 21), an open command is supplied to an open/close mechanism in the disk holder 38 (step 22), and "1" is set in the 4th bit in the mode flag register 41, thus storing the open state of the disk holder 38 (step 23).

7. Closing routine

Figure 7:
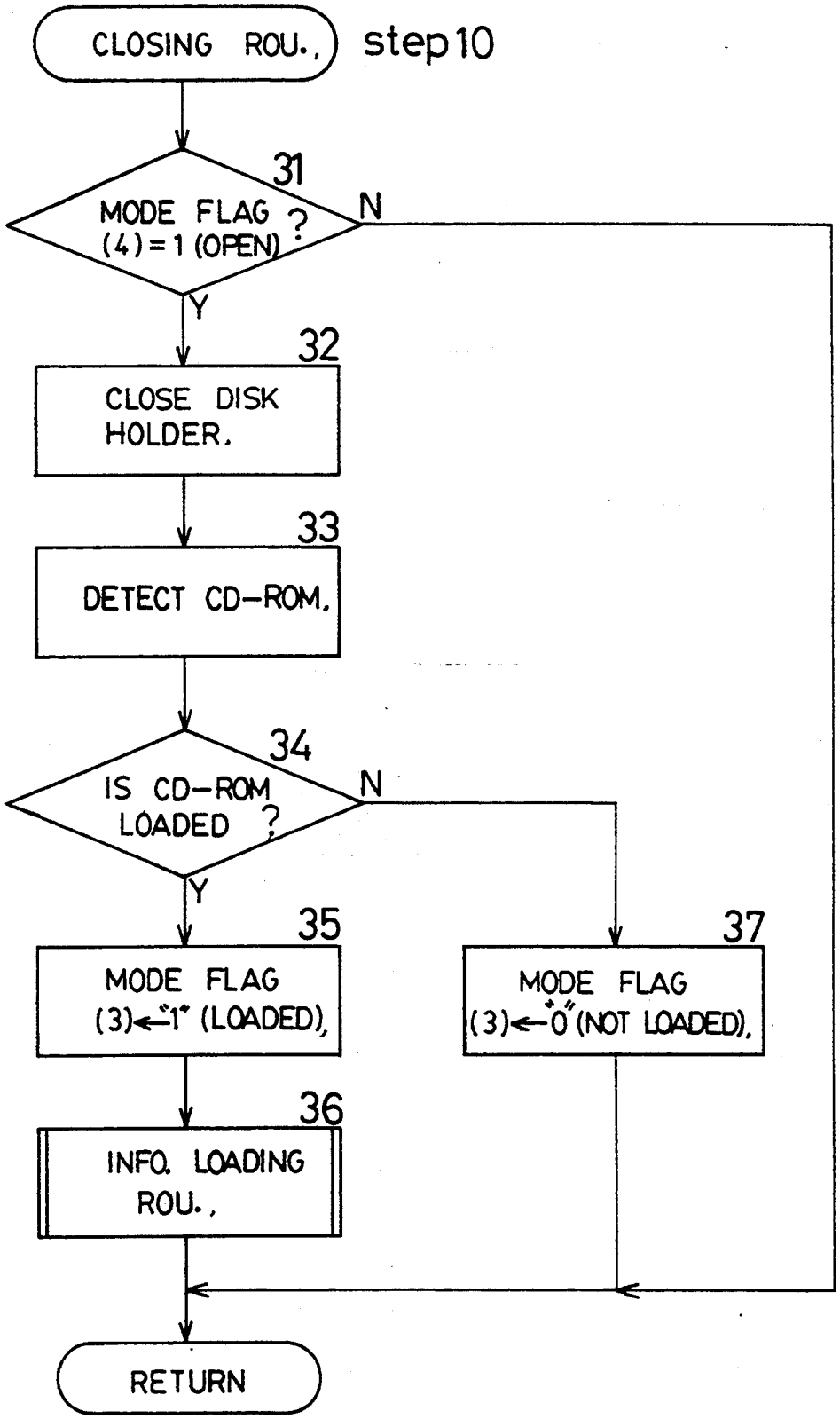
FIG. 7 is a flowchart showing a routine (step 10) of closing the disk holder 38.

FIG. 7 shows the routine executed in the step 10 to close the disk holder 38. In this routine, if the 4th bit of the mode flag register 41 is "1", indicating the open state of the disk holder 38 (step (31), a close command is supplied to the open/close mechanism of the disk holder 38 (step 32), and a scan signal is supplied to the sensor switch of the CD-ROM 8 (step 33).

If the signal from the sensor switch is "1", indicating that the CD-ROM 8 has been loaded (step 34), "1" is set in the 3rd bit of the mode flag register 41, thus storing the loaded state of the CD-ROM 8 (step 35), and then an information loading routine is executed (step 36). If the signal from the sensor switch is "0", indicating that the CD-ROM 8 is not loaded (step 34), "0" is set in the 3rd bit of the mode flag register 41 (step 37).

8. Information Loading Routine

Figure 8:
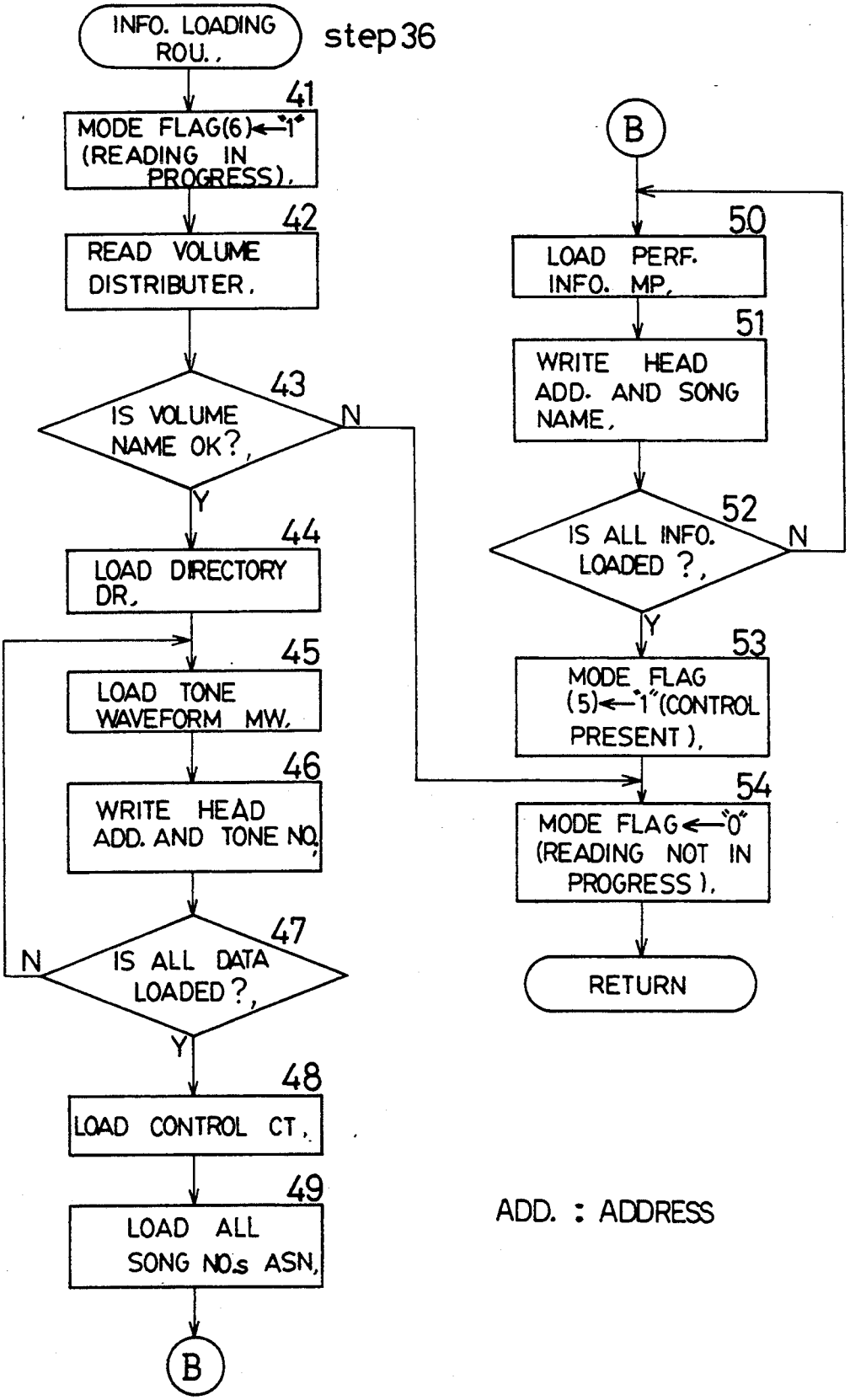
FIG. 8 is a flowchart showing an information loading routine (step 36)

FIG. 8 shows the flowchart of the routine executed in the step 36 to load information in the CD-ROM 8. In this routine, "1" is set in the 6th bit of the mode flag register 41, thus storing the data reading state of the CD-ROM 8 (step 41). Then, volume distributor VD in logic the sector of the CD-ROM 8 is read out through the CD interface 10 (step 42), and a check is made according to the volume name data VN of the volume distributer VD as to whether the type of the CD-ROM 8 conforms to the present electronic musical instrument (step 43).

If there is conformity, the directory data DR in the logic sector of the CD-ROM 8 is read out and loaded in the directory table 42 of the working memory 22 (step 44). Then, the first piece of musical tone waveform data MW in the CD-ROM 8 is read out and loaded in the musical tone waveform stock memory 12 (step 45). The head address data and tone number data TN loaded in the musical tone waveform stock memory 12 are written in the tone tables 50 (step 46).

The musical tone waveform data MW loading routine in the steps 45 and 46 is repeatedly executed for all pieces of musical tone waveform data MW in the CD-ROM 8 (step 47). For the tone number data TN, the file name in the directory table 42 is used. In this way, musical tone waveform data MW is automatically loaded in the musical tone waveform stock memory 12 set in the electronic musical instrument body by merely closing the disk holder 38.

Then, control information CT in the CD-ROM 8 is read out and loaded in the control memory 14 (step 48), and the all song number data ASN in the directory data DR in the directory table 42 is loaded in the song number register 43 (step 49). In this case, the same routine as in steps 46 and 47 may be executed with respect to the control information CT.

Next, the first piece of performance information MP in the CD-ROM 8 is read out and loaded in the performance information memory 13 (step 50). The loaded head address data and song name in the performance information memory 13 are written in the song table 44 (step 51). The performance information MP loading routine in the steps 50 and 51 is executed repeatedly with respect to all the performance information MP in the CD-ROM 8 (step 52). For the song name, the file name in the directory table 42 is used.

Subsequently, "1" is set in the 5th bit of the mode flag register 41, thus storing the state of presence of control information CT (step 53). Then, "0" is set in the 6th bit of the mode flag register 41, thus storing the no reading of data from the CD-ROM 8 state (step 54).

9. Play Routine

Figure 9:
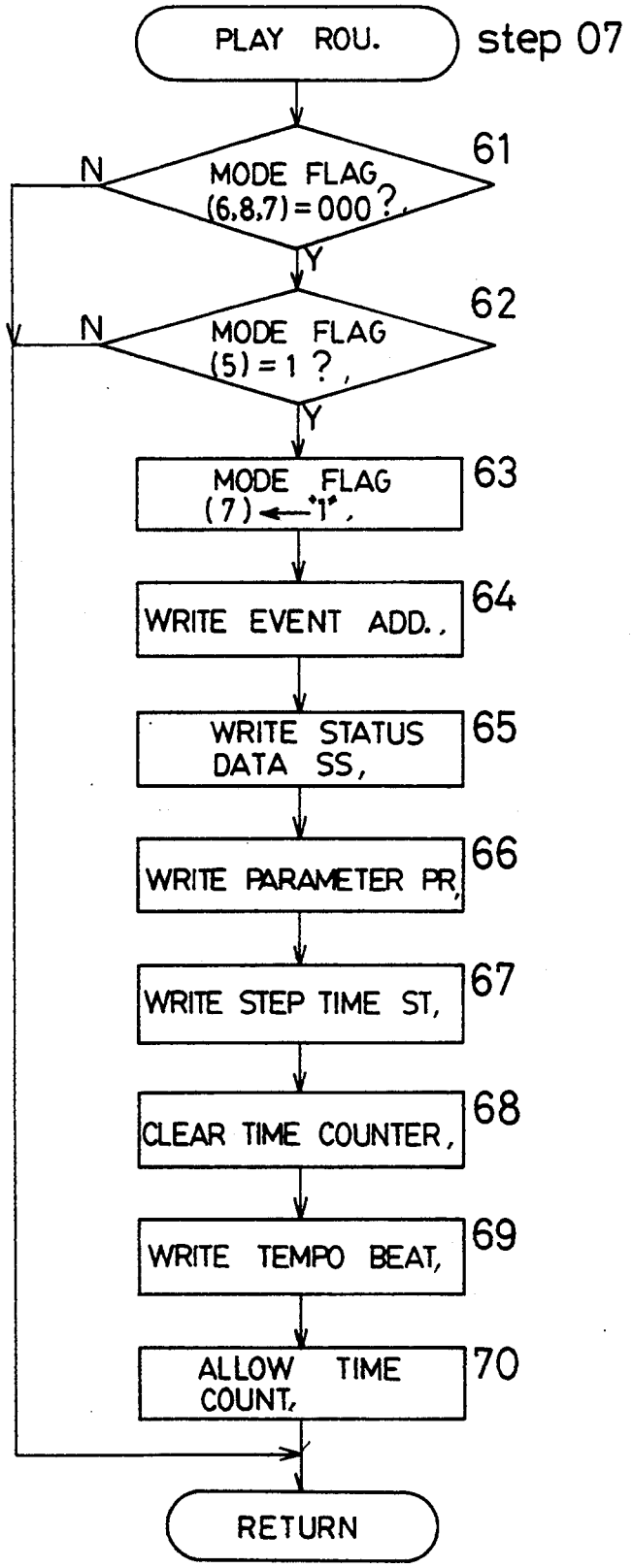
FIG. 9 is a flowchart showing an automatic performance routine (step 07)

FIG. 9 shows the flowchart of a play routine executed in the step 07 of automatic performance. In this routine, if the 6th to 8th bits of the mode flag register 41 are "000", indicating that no data is being read out from the CD-ROM 8, no automatic performance is in progress and no musical tone waveform data MW is being loaded (step 61), and also if the 5th bit of the mode flag register 41 is "1", indicating that control information CT is set in the control memory 14 (step 62), "1" is set in the 7th bit of the mode flag register 41, thus establishing an automatic performance mode (step 63).

Then, head address data in performance information MP of a song corresponding to the reproduced song number data RSN in the current song register 45 is read out from the song table 44 and written in the event address register 46 (step 64). Further, status data SS of performance information MP in the performance information memory 13 corresponding to the head address data is read out and written in the status register 47 (step 65). Then, parameter data PR in the performance information MP is read out and written in the parameter register 48 (step 66), and step time data ST in the performance information MP is read out and written in the step register 49 (step 67).

Then, the time counter 55 is cleared (step 68), and tempo beat data TB is written in the tempo beat register 56 (step 69), and "1" is set in the time counter latch 25 (step 70). Thus, time counting for the automatic performance is started, and the automatic performance is also started.

10. Stop Routine

Figure 10:
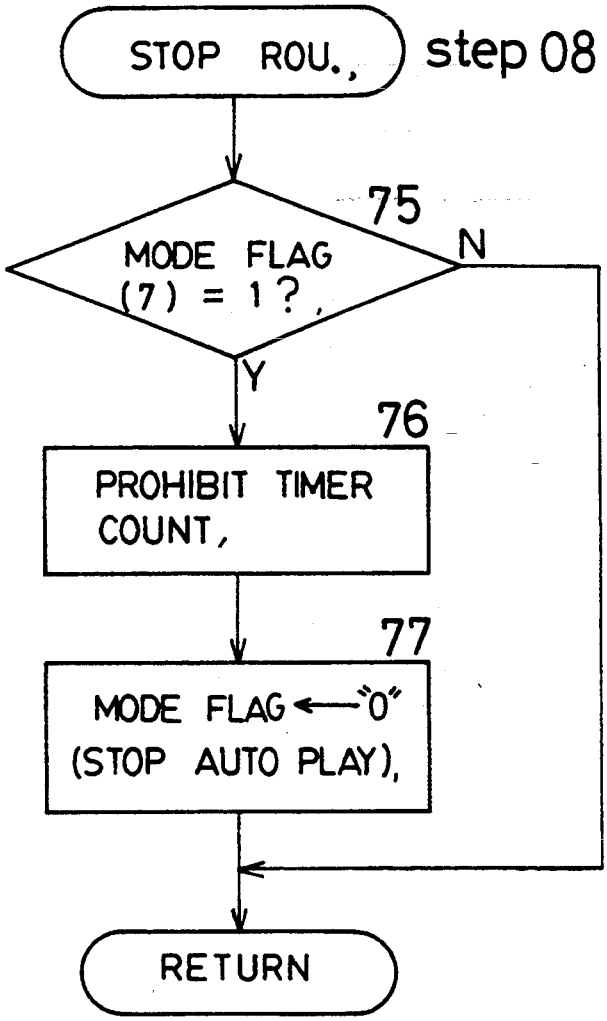
FIG. 10 is a flowchart showing an automatic performance stop routine (step 08)

FIG. 10 shows the flowchart for the automatic performance stop routine executed in the step 08. In this routine, if the 7th bit of the mode flag register 41 is "1", indicating that the automatic performance is in progress (step 75), data in the time count latch 25 is cleared to "0" (step 76), and also the 7th bit of the mode flag register 41 is cleared (step 77). Thus, the automatic performance is stopped.

11. Song Selection Routine

Figure 11:
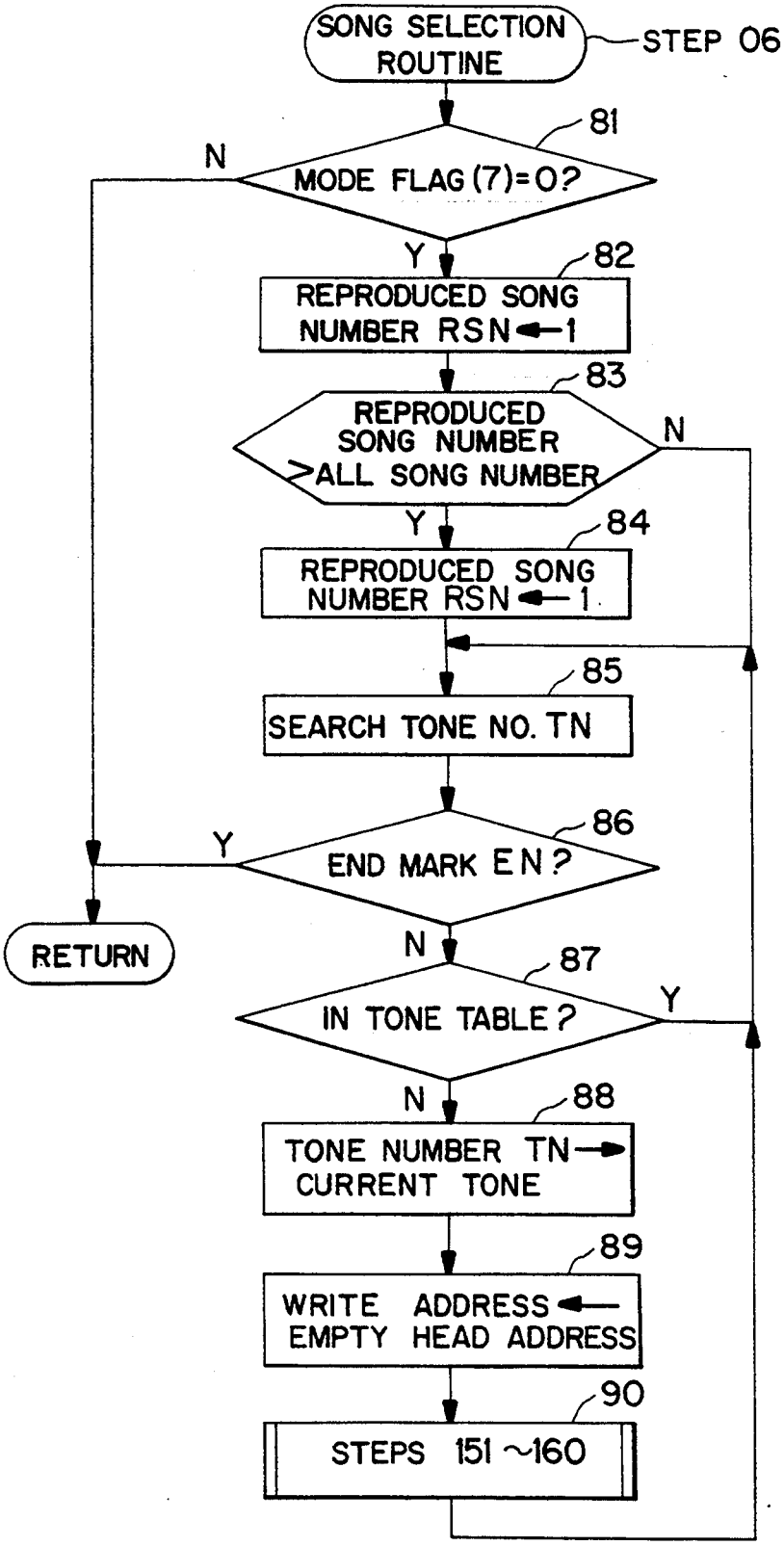
FIG. 11 is a flowchart showing an song selection routine (step 06)

FIG. 11 shows the flowchart of the song selection routine executed in the step 06. In this routine, if the 7th bit of the mode flag register 41 is "0", indicating that no automatic performance is in progress (step 81), the reproduced song number data RSN in the current song register 45 is incremented by "+1" (step 82). If the value of the reproduced song number data RSN exceeds the value of the all song number data ASN by incrementing with "+1" (step 84), the value of the reproduced song number data RSN is reset to "1" (step 84). This reproduced song number data RSN is displayed on the LCD 23 via the LCD driver 24. In the above way, it is possible to select a song for automatic performance by merely operating the song selection key 33.

Then, the tone number data TN in the performance information MP in the performance information memory 13 corresponding to the reproduced song number data RSN after the "+1" incrementation is searched for (step 85). If the tone number data TN is detected before end mark data ED (step 86), a check is made as to whether the same data as this tone number data TN is stored in the tone tables 50 concerning the musical tone waveform memory 16 (step 87).

If the data is not stored, the tone number data TN is set in the current tone register 51 (step 88), and head address data of empty area in the musical tone waveform memory 16 is set in the write address register 53 (step 89). Then, a routine for loading musical tone waveform data MW in steps 151 to 160 to be described later is executed (step 90).

In this way, if musical tone waveform data MW corresponding to the tone color in automatic performance has not been stored in the musical tone waveform memory 16, the necessary musical tone waveform data MW is automatically loaded in the musical tone waveform memory 16. It is possible to provide a set key in the panel switch group 3 for determining a song selected by operating the song selection key 33. In this case, a check as to whether the set key has been turned on is made between the steps 84 and 85. If the set key is "off", the routine goes to the step 81. If the set key is "on", the step 85 is executed.

Further, the routine of automatic loading of musical tone waveform data MW in the automatic performance executed in the steps 85 to 90 noted above, may be executed prior to the step 61 of the play routine. Further, the routine of automatic loading of musical tone waveform data MW in the automatic performance executed in the steps 85 to 90, may be executed between the CD-ROM 8 and musical tone waveform memory 16 or between the CD-ROM 8 and musical tone waveform stock memory 12. Further, the routine of automatic loading of musical tone waveform data MW in the automatic performance of the steps 85 to 90, may be executed with respect to the control information CT. In this case, the subject of processing is data designating control information CT, instead of tone number data TN.

12. Performance Information MP Reproduction Routine

Figure 12:
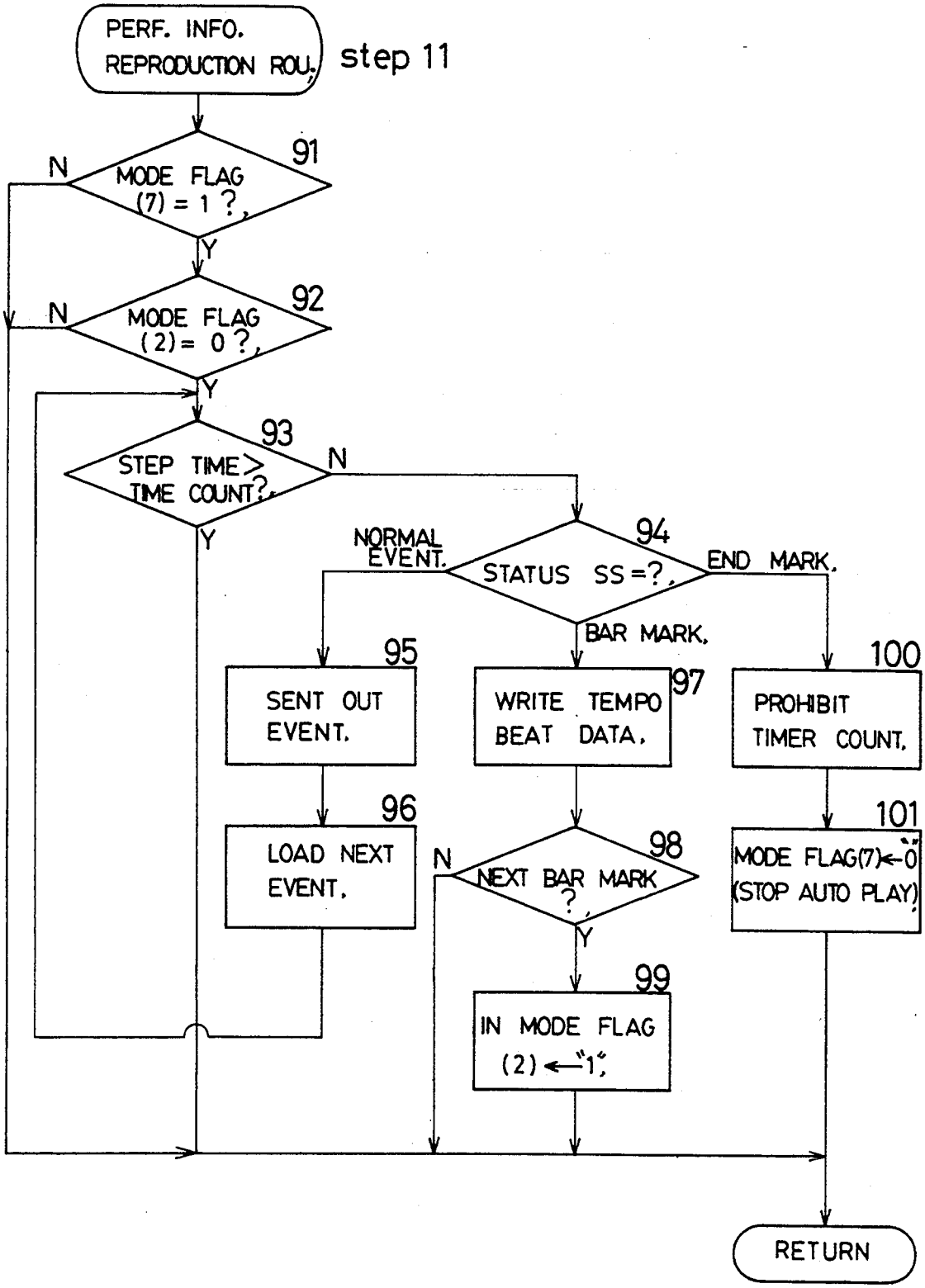
FIG. 12 is a flowchart showing a routine (step 11) of reproducing performance information MP.

FIG. 12 shows the flowchart of a performance information MP reproduction routine executed in the step 11. In this routine, if the 7th bit of the mode flag register 41 is "1", indicating that automatic performance is in progress (step 91), and also if the 2nd bit of the mode flag register 41 is "1", indicating that two or more bar marks have not been read out continuously (step 92), a check is made as to whether the step time data ST in the step register 49 has been reached by the time count data TC of the time counter 56 (step 93).

If the data has been reached, the content of status data SS in the event buffer register 46 is judged (step 94). If the data indicates an ordinary key-"on"/"off" state, key number, etc., it is supplied to the tone generator 15 and output through the MIDI interface 11 (step 95).

At this time, control information CT in the control memory 14 and parameter data PR in the parameter register 48 are also supplied, and further, tone number data TN and head address data corresponding to the control information CT and parameter data PR, respectively, are supplied. The head address data corresponds to the musical tone waveform memory 16 and is read out from the tone table 50. Thus, the of sounding according to the performance information MP is effected for automatic performance. The routine of the start/end of sounding in the step 95 is also executed at the time of the normal manual performance executed by operating the keyboard 1.

Next, the event address data EAD in the event address register 46 is incremented, and then the next status data SS, parameter data PR and step time data ST are read out and written in the status register 47, parameter register 48 and step register 49 (step 96).

If bar mark data BM is detected in the step 94, tempo beat data TB corresponding to beat data contained in the bar mark data BM is written in the tempo beat register 57 (step 97). Then, as in the step 96, the next status data SS is read out. If this data is bar mark data BM (step 98), "1" is set in the 2nd bit of the mode flag register 41 (step 99).

If end mark data ED is detected in the step 94, the data in the time count latch 25 is cleared to "0" (step 100), and the 7th bit of the mode flag register 41 is cleared (step 101). In this way, the automatic performance is stopped.

13. Performance information MP send/receive routine

Figure 13:
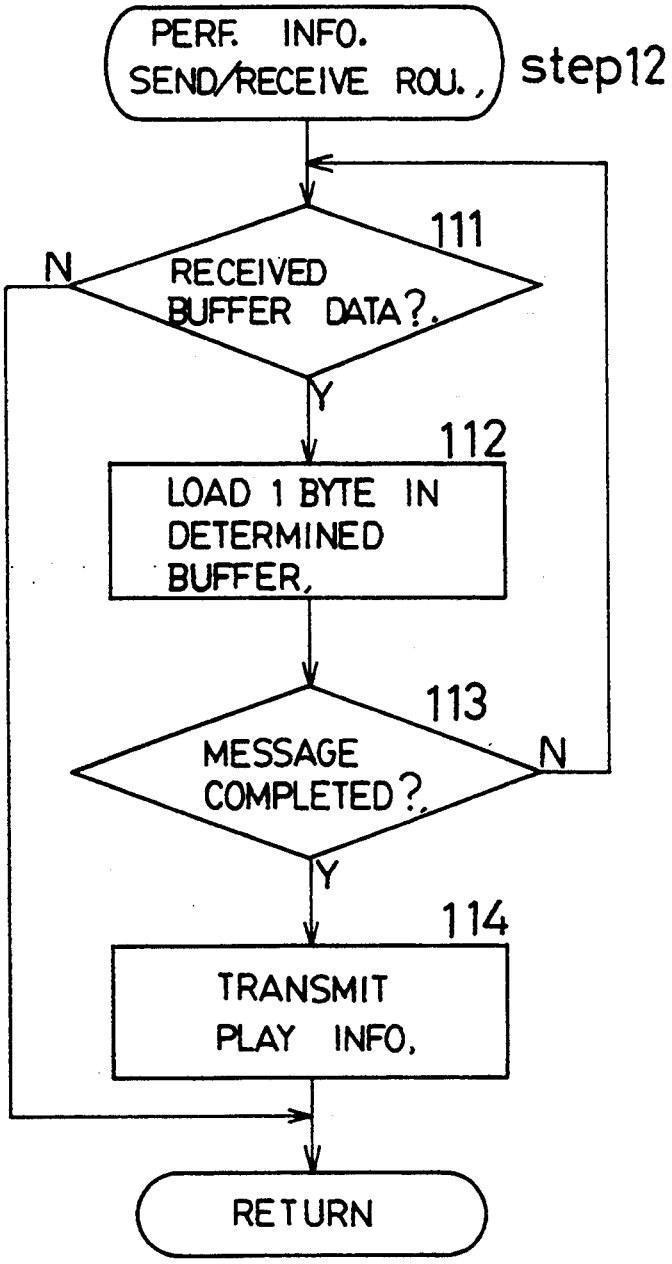
FIG. 13 is a flowchart showing a routine (step 12) of transmitting and receiving performance information MP.

FIG. 13 shows the flowchart of a performance information MP send/receive routine executed in the step 12. In this routine, a check is made as to whether performance information MP is stored in the received data buffer 58 (step 111). If performance information MP is stored, it is loaded in the determined data buffer 59 (step 112).

Then, a check is made as to whether the loaded performance information MP is complete (step 113). If it is not complete, the routine in the steps 111 and 112 is repeated until the information is complete. If the information is complete, it is now supplied to the tone generator 15 (step 114). The routine in the step 114 is the same as the routine in the step 95. In this way, automatic performance is executed with respect to externally input performance information MP.

14. Interrupt Routine

Figure 14:
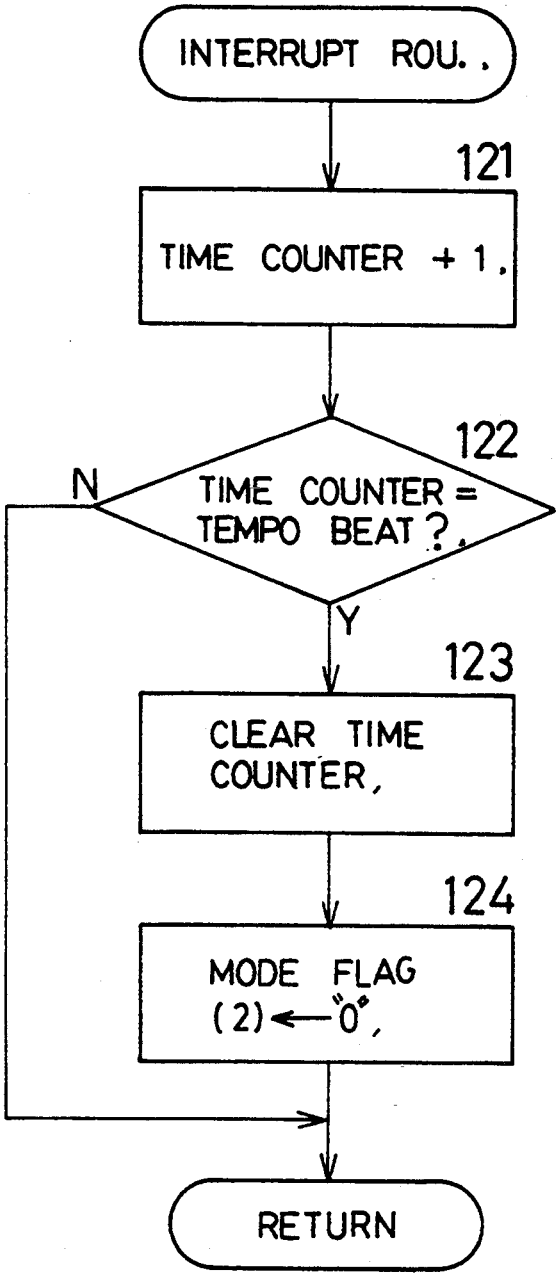
FIG. 14 is a flowchart showing an interrupt routine.

FIG. 14 shows the flowchart of an interrupt routine. This routine is executed whenever the clock signal $\phi$ goes to the high level. In the routine, the count of the time counter 56 is incremented by "+1" (step 121). If the value of the time count data TC in the time counter 56 becomes identical with the tempo beat data TB in the tempo beat register 57 (step 122), the time count data TC is cleared (step 123), and the 2nd bit of the mode flag register 41 is cleared (step 124). In this way, a wait for one bar is completed.

15. Musical Tone Waveform Data MW Loading Routine

Figure 15:
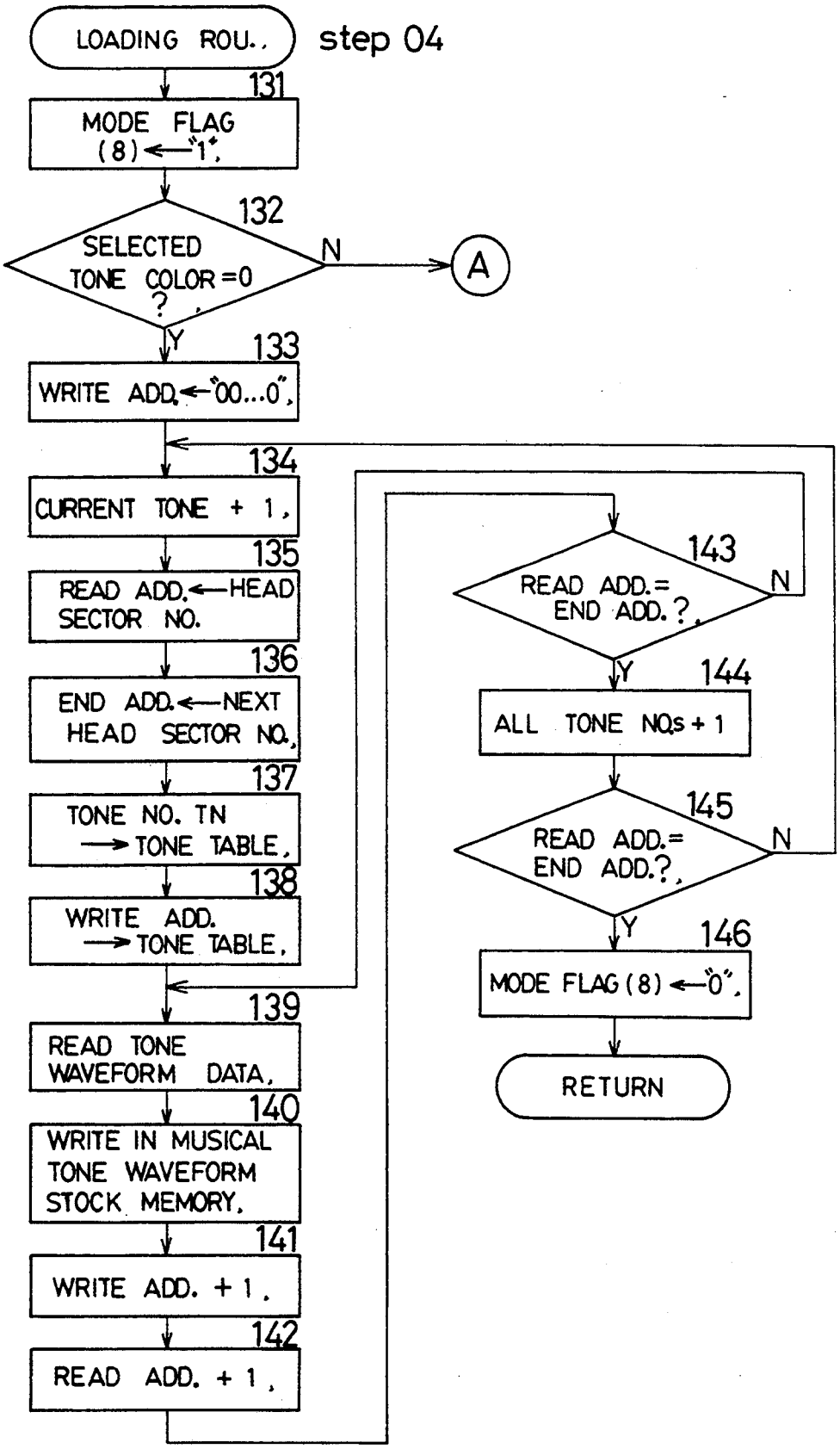
FIG. 15 is a flowchart showing a routine (step 04) of loading musical tone waveform data MW.

FIG. 15 shows the flowchart of a musical tone waveform data MW loading routine executed in the step 04. In this routine, "1" is set in the 8th bit of the mode flag register 41, thus storing that musical tone waveform data MW is being loaded (step 131), and a check is made as to whether point data designating tone number data TN in the current tone register 51 is "0" (step 132). If the point data is "0", indicating that all the tone number data TN have been designated, the write address register 54 is cleared to "00 . . . 0" (step 133), and the current tone register 51 is incremented by "+1" (step 134).

Then, the head sector number of the musical tone waveform data MW to be loaded, i.e., the head sector number in the directory table 42 designated by the current tone register 51, is set in the read address register 53 (step 135), and the head sector number of the next musical tone waveform data MW is set in the end address register 55 (step 136).

Next, the tone number data TN of the musical tone waveform data MW to be loaded, i.e., the file name in the directory table 42 designated by the current tone register 51, is read out and written in the tone tables 50 (step 137), and the value of the data in the write address register 54 is written as the head address data in the tone tables 50 (step 138).

Next, musical tone waveform data MW for one sector is read out from the CD-ROM 8 (step 139) and written in the musical tone waveform memory 12 (step 140), then the data in the write address register 54 is incremented by "+1" (step 141), and the data in the read address register 53 is incremented by "+1" (step 142). The musical tone waveform data MW loading routine in the steps 139 through 142, is repeatedly executed until the value of the data in the read address register 53 becomes identical to the value of the data in the end address register 54 (step 143).

If the values match, the loading of one piece of musical tone waveform data MW is completed, and the all tone color number data ATN in the tone number register 52 is incremented by "+1" (step 144). The loading routine in the steps 134 and 144 is repeated for all the musical tone waveform data MW, that is, until the value of the data in the read address register 53 reaches the end sector number in the CD-ROM 8 (step 145). When the loading routine is ended, the 8th bit of the mode flag register 41 is cleared (step 146).

In the above way, by selecting the tone number data TN of "0" with the tone color selection key 32 and turning on the load key 31, the musical tone waveform data MW in the CD-ROM 8 can be automatically loaded in the musical tone waveform stock memory 12 in the electronic musical instrument. The steps 45 to 47 are the same as the steps 131 to 146. It is possible to execute the musical tone waveform data MW loading routine in the steps 131 to 146 between the musical tone waveform stock memory 12 and musical tone waveform memory 16.

If it is found in the step 132 that the point data designating the tone number data TN in the current tone register 51 is not "0" and tone number data TN is designated independently, the head address data of musical tone waveform data MW to be loaded, i.e., the head address data of the tone table 50 designated by the current tone register 51, is set in the read address register 53 (step 151), and the head address data of the next musical tone waveform data MW is set in the end address register 55 (step 152).

Next, the tone number data TN of the musical tone waveform data MW to be loaded, i.e., the tone number data TN in the tone table 50 designated by the current tone register 51 is read out and written in the other tone table 50 (step 153), and the value of the data in the write address register 54 is written as head address data in the other tone table 50 (step 154).

Then, musical tone waveform data MW is read out for one address from the musical tone waveform stock memory 12 (step 155) and written in the musical tone waveform memory 16 (step 156), the data in the write address register 54 is incremented by "+1" (step 157), and the data in the read address register 53 is incremented by "+1" (step 158).

The musical tone waveform data MW loading routine in the steps 155 to 158 is repeated until the value of the data in the read address register 53 is equal to the value of the data in the end address register 55 (step 159). When this loading routine is ended, the all tone color number data ATN in the other tone number register 52 is incremented by "+1" (step 160), and the 8th bit of the mode flag register 41 is cleared (step 161).

In the above way, by selecting a specific piece of tone number data TN with the tone color selection key 32 and turning on the load key 31, the selected musical tone waveform data MW in the musical tone waveform stock memory 12 is automatically loaded in the musical tone waveform memory 16 in the tone generator 15. It is possible to execute the musical tone waveform data MW loading routine in the steps 151 through 161 between the CD-ROM 8 and musical tone waveform stock memory 12. It is further possible to execute this musical tone waveform data MW loading routine in the steps 131 to 161 between the CD-ROM 8 and control memory 14.

16. Tone Color Selection Routine

Figure 16:
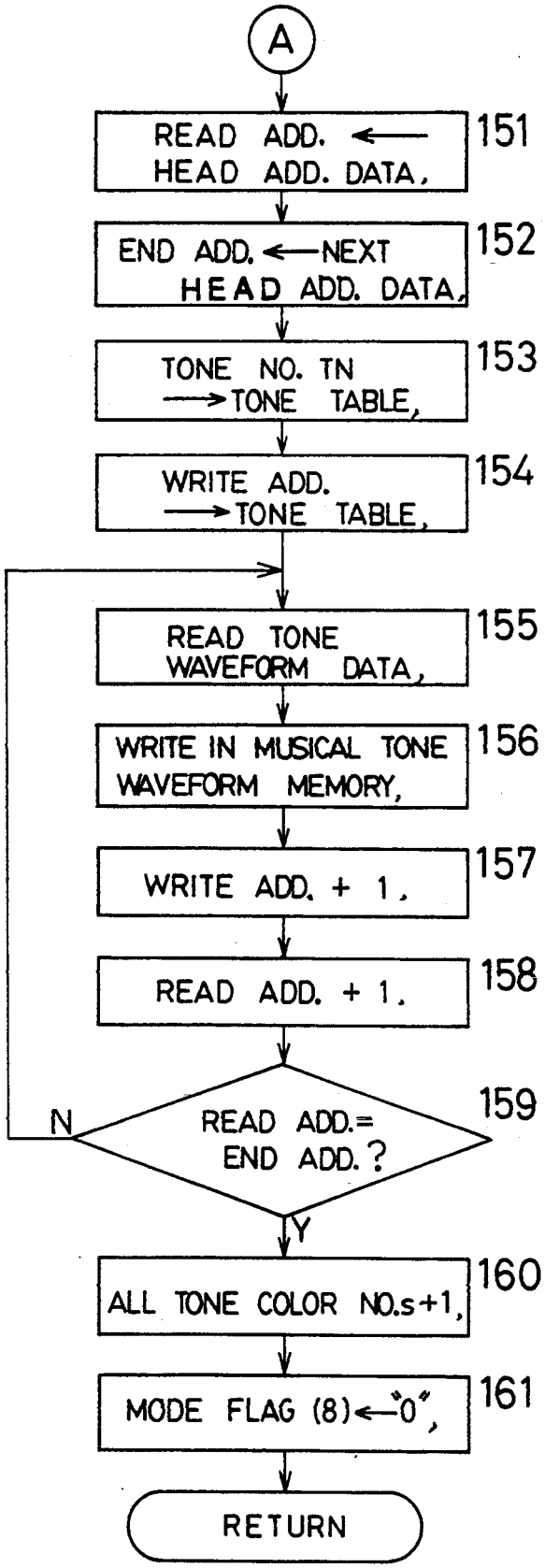
FIG. 16 is a flowchart showing the routine (step 04) of loading musical tone waveform data MW.
Figure 17:
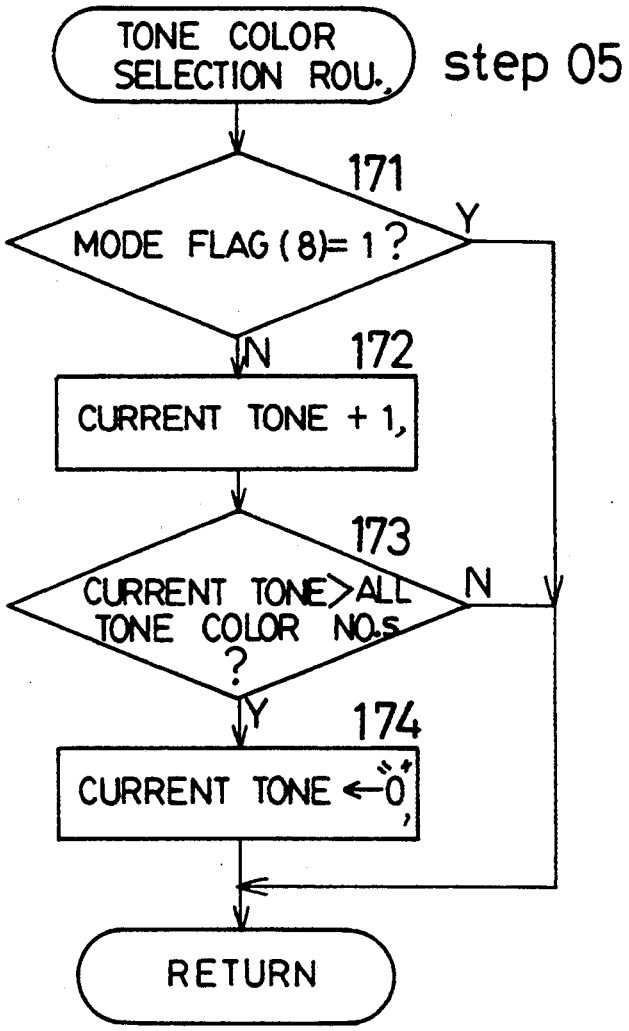
FIG. 17 is a flowchart showing a tone color selection routine (step 05).

FIG. 16 shows the flowchart of a tone color selection routine executed in the step 05 with respect to musical tone waveform data MW. In this routine, if the 8th bit of the mode flag register 41 is "0", indicating that the loading of musical tone waveform data MW is not in progress (step 171), the point data of the current tone register 51 is incremented by "+1" (step 172).

If this incrementation by "+1" causes the point data value to exceed the value of the all tone color number data ANT in the other tone number register 52 (step 171), the point data is reset to "0" (step 174). The tone number data TN in the tone table 50 designated by the point data is supplied via the LCD driver 24 to the LCD 23 for display thereon. In the above way, it is possible to select the tone color of a tone to be sounded by merely operating the tone color selection key 32.

In the tone color selection routine, it is possible to store tone number data TN in the current tone register 51 and increment this data TN. If the same data as the incremented tone number data TN is not stored in the tone table 50 after the step 172, the automatic musical tone waveform data MW automatic loading routine in the automatic performance in the steps 80 through 90 may be executed. This routine may also be executed with respect to tone number data TN and control information CT.

The above embodiment of the invention is by no means limitative and may be modified in various ways without departing from the scope and spirit of the invention. For example, it is possible that the memories 8, 12 and 16 stored the musical tone waveform data MW are replaced with ROM/RAM cards or similar semiconductor memories, and also magnetic memories such as floppy disks, cassette tapes, etc. Further, the musical tone waveform stock memory 12 and musical tone waveform memory 16 may be optical memories such as CD-ROM 8 or semiconductor memories such as a ROM/RAM card. Further, any of these may be mounted in and dismounted from the electronic musical instrument body. Further, it is possible to employ a plurality of CD-ROMs 8, musical tone waveform stock memories 12 and musical tone waveform memories 16. Further, the control information CT may include data for controlling effect, rhythm, transposition, touch, volume, tempo, quantization, etc.

What is claimed is:

1. A waveform data reading/writing device for an electronic musical instrument comprising:

first waveform storage means capable of being mounted in and removed from said electronic musical instrument and having storage capacity to store data of musical tone waveforms;

first reading means for reading the data of musical tone waveforms from said first waveform storage means;

third waveform storage means, in said electronic musical instrument, for storing the data of musical tone waveforms read by said first reading means;

third writing means for writing the data of musical tone waveforms read by said first reading means in said third waveform storage means;

third reading means for reading the data of musical tone waveforms from said third waveform storage means;

second waveform storage means, in said electronic musical instrument, including a semiconductor for storing the data of musical tone waveforms read by said third reading means;

second writing means for writing the data of musical tone waveforms read by said third reading means in said second waveform storage means;

automatic performance information storing means for storing automatic performance information;

automatic performance information reading means for reading the automatic performance information in an order of performance from said automatic performance information storing means;

designating means for designating a musical tone according to the automatic performance information read by said automatic performance information reading means;

second reading means for reading the data of musical tone waveforms from said second waveform storage means according to a designation by said designating means;

output means for outputting the data of musical tone waveforms read by said second reading means as data concerning the musical tone designated by said designating means;

checking means for executing a check with respect to the musical tone designated by said designating means as to whether the data of musical tone waveforms corresponding to the musical tone designated is stored in said second waveform storage means;

fourth reading means for reading the data of musical tone waveforms from said third waveform storage means according to the check by said checking means; and fourth writing means for writing the data of musical tone waveforms read by said fourth reading means in said second waveform storage means.

2. The waveform data reading/writing device for an electronic musical instrument according to claim 1, wherein the data of musical tone waveforms is of a sampled type.

3. The waveform data reading/writing device of claim 1, wherein the data of musical tone waveforms corresponds to sounds of various musical instruments or corresponds to groups of spectra of specific frequency bands according to specific formants.

4. The waveform data reading/writing device of claim 1, wherein the data of musical tone waveforms corresponds to touch data, range of touch data, pitch data, or range of pitch data.

5. A method of waveform data reading/writing for an electronic musical instrument comprising the steps of:

(a) storing data of musical tone waveforms in a first waveform storage area capable of being mounted in and removed from said electronic musical instrument and having storage capacity;
(b) reading the data of musical tone waveforms from the first waveform storage area;
(c) writing the data of musical tone waveforms read in step (b) in a third waveform storage area provided in said electronic musical instrument;
(d) reading the data of musical tone waveforms from the third waveform storage area;
(e) writing the data of musical tone waveforms read in step (d) in a second waveform storage area provided as a semiconductor in said electronic musical instrument;
(f) storing automatic performance information;
(g) reading the automatic performance information in an order of performance stored in step (f);
(h) designating a musical tone according to the automatic performance information read in step (g);
(i) reading the data of musical tone waveforms from the second waveform storage area according to the designation in step (h);
(j) outputting the data of musical tone waveforms read in step (i) as data concerning the musical tone designated in step (h);
(k) checking with respect to the musical tone designated in step (h), whether the data of musical tone waveforms is stored in the second waveform storage area;
(l) reading the data of musical tone waveforms from the third waveform storage area according to a result of the check in step (k); and
(m) writing the data of musical tone waveforms read in step (l) in the second waveform storage area.

6. The method of waveform data reading/writing of claim 5, wherein the data of musical tone waveforms is of a sampled type.

7. The method of waveform data reading/writing of claim 5, wherein the data of musical tone waveforms corresponds to sounds of various musical instruments or corresponds to groups of spectra of specific frequency bands according to specific formats.

8. The method of waveform data reading/writing of claim 5, wherein the data of musical tone waveforms corresponds to touch data, range of touch data, pitch data, or range of pitch data.

9. A waveform data reading/writing device for an electronic musical instrument comprising:

first waveform storage means for storing data of musical tone waveforms;

first reading means for reading the data of musical tone waveforms from said first waveform storage means;

second waveform storage means set in said electronic musical instrument for storing data of musical tone waveforms used for musical tone generation;

second writing means for writing the data of musical tone waveforms read by said first reading means in said second waveform storage means;

automatic performance information storing means for storing automatic performance information;

automatic performance information reading means for reading the automatic performance information in an order of performance from said automatic performance information storing means;

designating means for designating a musical tone according to the automatic performance information read by said automatic performance information reading means;

second reading means for reading the data of musical tone waveforms from said second waveform storage means according to a designation by said designating means;

output means for outputting the data of musical tone waveform read by said second reading means as data concerning the musical tone designated by said designating means;

checking means for executing a check with respect to the musical tone designated by said designating means as to whether the data of musical tone waveforms corresponding to the musical tone designated is stored in said second waveform storage means;

third reading means for reading the data of musical tone waveforms from said first waveform storage means according to a result of the check by said checking means; and third writing means for writing the data of musical tone waveforms read by said third reading means in said second waveform storage means.

10. The waveform data reading/writing device of claim 9, wherein the data of musical tone waveforms corresponds to sounds of various musical instruments or corresponds to groups of spectra of specific frequency bands according to specific formats.

11. The waveform data reading/writing device of claim 9, wherein the data of musical tone waveforms corresponds to touch data, range of touch data, pitch data or range of pitch data.

12. The waveform data reading/writing device of claim 9, wherein the data of musical tone waveforms is of a sampled type.

13. The waveform data reading/writing device of claim 9, wherein said first reading and second writing means write the data of musical tone waveforms read from said first waveform storage means in third waveform storage means, read the data of musical tone waveforms from said third waveform storage means and write the read data in said second waveform storage means.

14. The waveform data reading/writing device of claim 9, wherein said first waveform storage means is capable of being mounted in and removed from said electronic musical instrument.

15. A method of waveform data reading/writing for an electronic musical instrument comprising the steps of:

(a) storing data of musical tone waveforms in a first waveform storage area;
(b) storing data of musical tone waveforms used for musical tone generation in a second waveform storage area set in the electronic musical instrument;
(c) reading out the data of musical tone waveforms from the first waveform storage area;
(d) writing the data of musical tone waveforms read in step (c) in the second waveform storage area;
(e) storing automatic performance information;
(f) reading the automatic performance information in an order of performance stored in step (e);
(g) designating musical tone generation according to the automatic performance information read in step (f);

(h) reading the data of musical tone waveforms from the second waveform storage area according to the designation in step (g);

(i) outputting the data of musical tone waveforms read in step (h) as data concerning the musical tone designated in step (g);

(j) checking, with respect to the musical tone designated in step (g), whether the data of musical tone waveforms is stored in the second waveform storage area:

(k) reading the data of musical tone waveforms from the first waveform storage area according to a result of the check in step (j); and (l) writing the data of musical tone waveforms read in step (k) in the second waveform storage area.

16. The method of waveform data reading/writing of claim 15, wherein the data of musical tone waveforms corresponds to sounds of various musical instruments or corresponds to groups of spectra of specific frequency bands according to specific formants.

17. The method of waveform data reading/writing of claim 15, wherein the data of musical tone waveforms corresponds to touch data, range of touch data, pitch data, or range of pitch data.

18. The method of waveform data reading/writing of claim 15, wherein the data of musical tone waveforms is of a sampled type.

19. The method of waveform reading/writing of claim 15, wherein the reading in step (c) and writing in step (d) are executed to write the data of musical tone waveforms read from the first waveform storage area in a third waveform storage area, read the data of musical tone waveforms from the third waveform storage area and write the read data in the second waveform storage area.

20. The method of waveform data reading/writing of claim 15, wherein the first waveform storage area is capable of being mounted in and removed from the electronic musical instrument.

21. The waveform data reading/writing device of claim 1, wherein the reading of the data of musical tone waveforms by said second reading means is controlled by a start address, loop top address, and loop end address.

22. The method of waveform data reading/writing of claim 5, wherein the reading of the data of musical tone waveforms in step (i) is controlled by a start address, loop top address, and loop end address.

23. The waveform data reading/writing device of instrument according to claim 9, wherein the reading of the data of musical tone waveforms by said second reading means is controlled by a start address, loop top address, and loop end address.

24. The method of waveform data reading/writing of claim 15, wherein the reading of the data of musical tone waveforms in step (h) is controlled by a start address, loop top address, and loop end address.

* * * * *